US005717981A

United States Patent [19]

Yamanaka

[11] Patent Number: 5,717,981

[45] Date of Patent: Feb. 10, 1998

[54] DEVELOPING DEVICE FOR ELECTROPHOTOGRAPHIC IMAGE FORMING APPARATUS

[75] Inventor: Tetsuo Yamanaka, Tokyo, Japan

[73] Assignee: Ricoh Company Ltd., Tokyo, Japan

[21] Appl. No.: 688,771

[22] Filed: Jul. 31, 1996

[30] Foreign Application Priority Data

Aug. 28, 1995 [JP] Japan ..... 7-219151

[51] Int. Cl.[6] ..... G03G 15/16

[52] U.S. Cl. ..... 399/101; 399/45; 399/66; 399/297; 399/391

[58] Field of Search ..... 399/66, 101, 128, 399/297, 313, 314, 45, 308, 391, 392

[56] References Cited

FOREIGN PATENT DOCUMENTS

| | | |
|---|---|---|
| 2-272590 | 11/1990 | Japan . |
| 5-46038 | 2/1993 | Japan . |
| 6-51655 | 2/1994 | Japan . |
| 7-44069 | 2/1995 | Japan . |

*Primary Examiner*—Arthur T. Grimley
*Assistant Examiner*—Quana Grainger
*Attorney, Agent, or Firm*—Oblon, Spivak, McClelland, Maier & Neustadt, P.C.

[57] ABSTRACT

In an electrophotographic image forming apparatus having a toner image forming device, an image transfer device includes an image transfer roller for transferring the toner image to a sheet in an image transferring operation. At least two sheet feeding devices feed and convey a sheet to the image transfer device, at least one of the feeding devices having a sheet width sensor. A power supply applies a bias to the image transfer device and a control device controls the application of the bias so as to remove toner on said image transfer roller between image transferring operations. The control device applies the bias for a predetermined time, or with a predetermined voltage, when it has received a signal indicative of a width of the sheet conveyed to the image transfer device and applies the bias for a longer time, or with a higher voltage, when it has not received a signal indicative of a width of the sheet conveyed to the image transfer device.

6 Claims, 4 Drawing Sheets

DEVELOPING DEVICE FOR ELECTROPHOTOGRAPHIC IMAGE FORMING APPARATUS

BACKGROUND OF THE INVENTION

1. Field of the Invention

The present invention relates to an electrophotographic image forming apparatus applicable to, e.g., a copier, facsimile apparatus or printer and, more particularly, to an image forming apparatus including a cleaning function for a contact type image transfer device.

2. Discussion of Background

An image forming apparatus including a cleaning function for a contact type image transfer device may have the construction taught in Japanese Patent Laid-Open Publication No. 5-46038 or No. 6-51655. The image forming apparatus in Japanese Patent Laid-Open Publication No. 5-46038 has a power supply with a polarity opposite that of an image transfer power supply, and a switch selects which of the power supply and the opposite power supply is connected with the image transfer roller. When a recording paper is to have an image transferred thereto, the opposite power supply is connected with the image transfer roller by the switch and a control unit applies a high-voltage of a correct polarity to the image transfer roller.

The control unit which controls an electrical charge device and a developing device rotates a drum by a determined quantity. By this rotation of the drum, the toner on the image transfer roller returns to the drum to be collected.

The image forming apparatus in Japanese Patent Laid-Open Publication No. 6-51655, checks and recognizes the width of the paper before image transfer. In case the width is larger than normal, a control unit applies a longer or higher voltage cleaning bias to the transfer roller before the next image transfer. This prevents the back of the paper from becoming dirty and other image transfer troubles.

It is known to omit the mechanism that checks and recognizes the width of paper in the sheet tray, in order to reduce cost. However, such an apparatus cannot check and recognize the width of the paper in the tray, so that the toner image on the drum may be wider than the width of the transfer sheet and unnecessary toner is formed on the drum. In such a case, the toner on the drum does not transfer to the sheet and remains on the image transfer roller. The toner on the image transfer roller stains the back of the next sheet.

SUMMARY OF THE INVENTION

It is therefore an object of the present invention to provide an image forming apparatus capable of preventing the back of a subsequent sheet from becoming dirty and preventing image transfer troubles, without use of a device for mechanically checking or recognizing the width of a sheet.

In accordance with the present invention, an image forming apparatus has a contact type image transferring device for transferring a toner image on the drum to a recording medium, one or more sheet feeding devices for transferring a sheet to the image transferring device and a control device. When the control device cannot recognize the width of the setting sheet, it sets up a longer time or a higher voltage for the cleaning bias applied to the roller before the next image forming operation.

Further, in accordance with the present invention, when an operator selects manual sheet feeding, the control device sets up a longer time or a higher voltage for the cleaning bias applied to the roller before the next image forming operation.

BRIEF DESCRIPTION OF THE DRAWINGS

The above and other objects, features and advantage of the present invention will become more apparent from the following detailed description taken with the accompanying drawings in which:

FIGS. 2-1 and 2-2 show a flow chart according to the first embodiment; and

DESCRIPTION OF THE PREFERRED EMBODIMENTS

Figure 1:
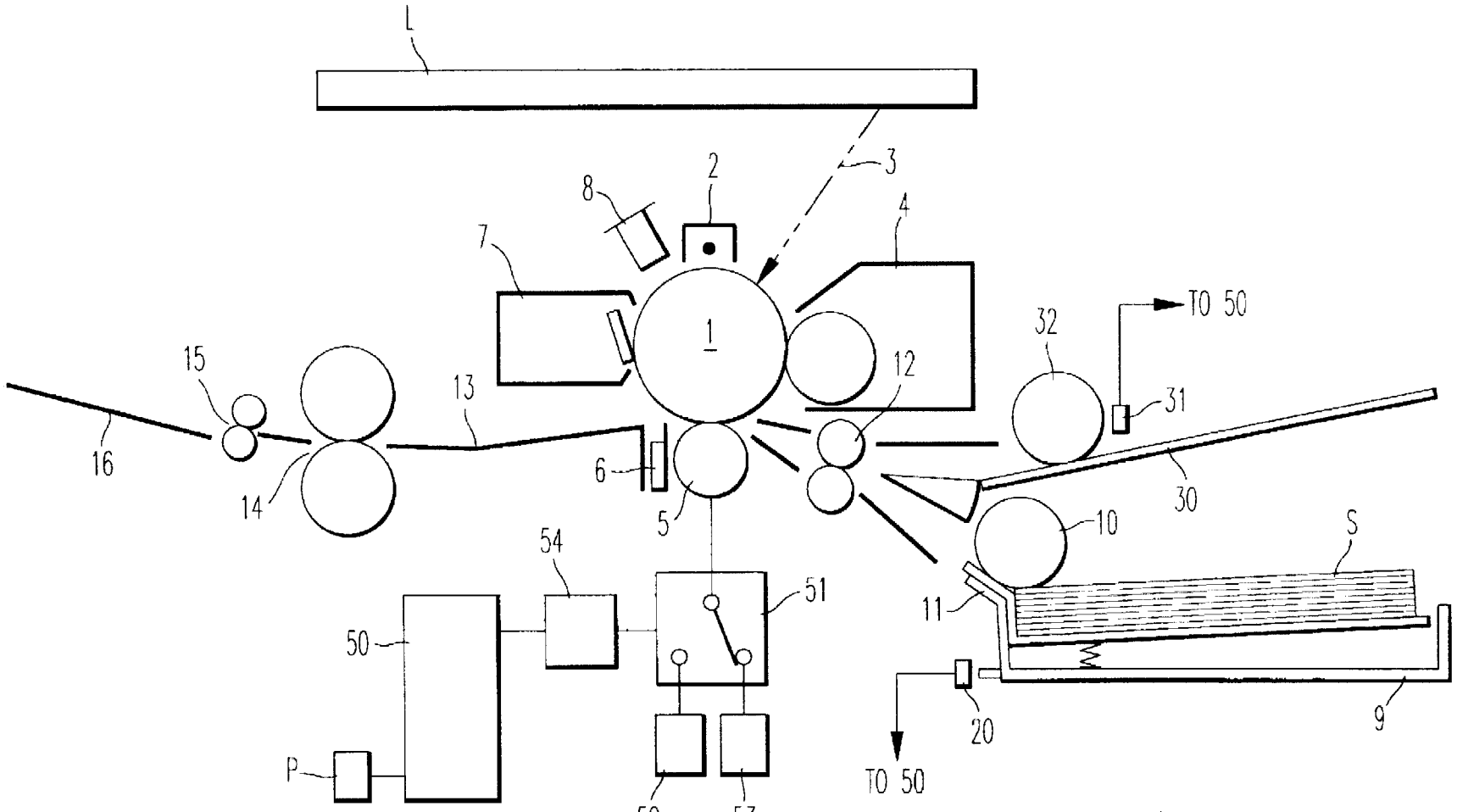
FIG. 1 is a section view showing a first embodiment of the image forming apparatus in accordance with the present invention.

Referring to FIG. 1, the basic construction of an image forming apparatus in accordance with the present invention has a drum 1 which is charged with a negative polarity from a power supply unit (not shown). Around this drum 1 are arranged a charger 2, a developing unit 4, an image transfer roller (contact type) 5, an electronic charge remover 6, a cleaner 7 and an eraser 8. The charger 2 applies a fixed voltage from a power supply (not shown) and uniformly charges the surface of the drum 1. The developing unit 4 develops the latent image with toner charged with the same polarity (negative) as the drum 1.

The image transfer roller 5 connects to either a positive power supply 52 that applies a bias of a positive polarity or a negative power supply 53 that applies a bias of a negative polarity, based upon the position of a select switch 51. The select switch 51 is moved by a switch drive unit 54 under the control of all of the overall control unit 50. The control unit 50 is comprised of a microcomputer and connects to an operation board P, a sheet feeding cassette 9, a sheet width sensor 20, a sheet feeding sensor 31, and the like.

The operation board P has a print key (not shown) for setting the number of copies and copy start key. The sheet feeding sensor 31 generates a detect signal and sends the detect signal to the control unit 50 when sheets are detected on the sheet tray 30.

Around the image transfer roller 5 are arranged a pair of timing rollers 12 and a sheet feeding cassette 9. The sheet feeding cassette 9 contains sheets S. It includes a sheet feeding roller 10 having a backing board 11 and a sheet sensor 20 for detecting the width of the sheets S.

On the left side of the electronic charge remover 6 are arranged a sheet guide 13, a pair of fixing rollers 14, a pair of discharge rollers 15 and a sheet stacking tray 16.

An optical writing device L located above on the drum 1 includes an exposure device 3 for exposing a latent image on the surface of the drum 1 based on image information from a document.

In accordance with this copy machine, when the print switch on the operation board P is turned on, the control unit 50 drives a main motor (not shown) and rotates the drum 1 in a clockwise direction, and also rotates the image transfer roller 5 which contacts drum 1 in a counter clockwise direction. Further, the control unit 50 controls the pair of timing rollers 12, the sheet feeding roller 10, the developing unit 4, and the fixing rollers 14 with a predetermined timing. The surface of the drum 1 is uniformly charged by the charger 2 and the charged area on the drum 1 is exposed by the exposing device 3 so that a latent image is formed on surface of the drum 1.

After this, the developing unit 4 develops the latent image on the drum 1 for making a toner image which rotates towards the image transfer roller 5. On the other hand, the sheet feeding roller 10 rotates and feeds a sheet from the sheet feeding cassette 9 to the pair of timing rollers 12.

When the top of the fed sheet reaches the timing rollers 12, the timing rollers 12 feed the sheet to the image transfer roller 5 and then the image transfer roller 5 transfers the toner image from the drum 1 to the sheet.

The electronic charge remover 6 separates the sheet from the drum 1 and the sheet is conveyed to the fixing roller 14 via the sheet guide 13. Then the fixing rollers 14 fix the toner image on the sheet and the discharging rollers 15 discharge the sheet to the sheet stacking tray 16. Residual toner image remaining on the drum 1 is cleaned up by the cleaner 7, and any charge remaining on the drum 1 is erased by eraser 8.

Next, will be explained how to select the voltage to be applied to the image transfer roller 5 during copying.

The control unit 50 applies a positive electrical bias to the image transfer roller 5 by controlling the switch driver 51 when the charger 2 charges the surface of the drum 1. Also, the control unit 50 applies a negative electrical bias for cleaning the drum 1 by controlling the switch driver 51 before the next toner image transfer operation. By the way, the negative bias for cleaning is 0 V.

Also, when the control unit 50 cannot recognize the width of the setting paper, for example in case of feeding the sheet from the sheet tray 30 which lacks a sheet width sensor, the control unit 50 applies the negative bias to the image transfer roller 5 for a longer time, e.g., 1.5 sec to 10.0 sec. as compared to 0.0 sec to 1.5 sec.

As will be explained, the selection of the time length of the electrical bias applied to the image transfer roller 5 is based on signals fed from the feeding sensor 31 to the control unit 50 and indicating whether sheets have been placed by an operator on the sheet tray 30. By such a configuration, even though the latent image formed on the drum 1 is wider than the width of the sheets on the sheet tray 30 and the toner image sticks to the image transfer roller 5 from the drum 1, the sticking toner on the image transfer roller 5 is returned to the drum 1 by the negative bias applied to the image transfer roller 5 in the next rotation, so that the image transfer roller 5 is cleaned. Consequently, even though the latent image formed on the drum 1 is wider than the width of the setting sheets S and the toner image sticks to the image transfer roller 5 from the drum 1, the back of the next sheet will not become dirtied by toner.

Figure 2A:
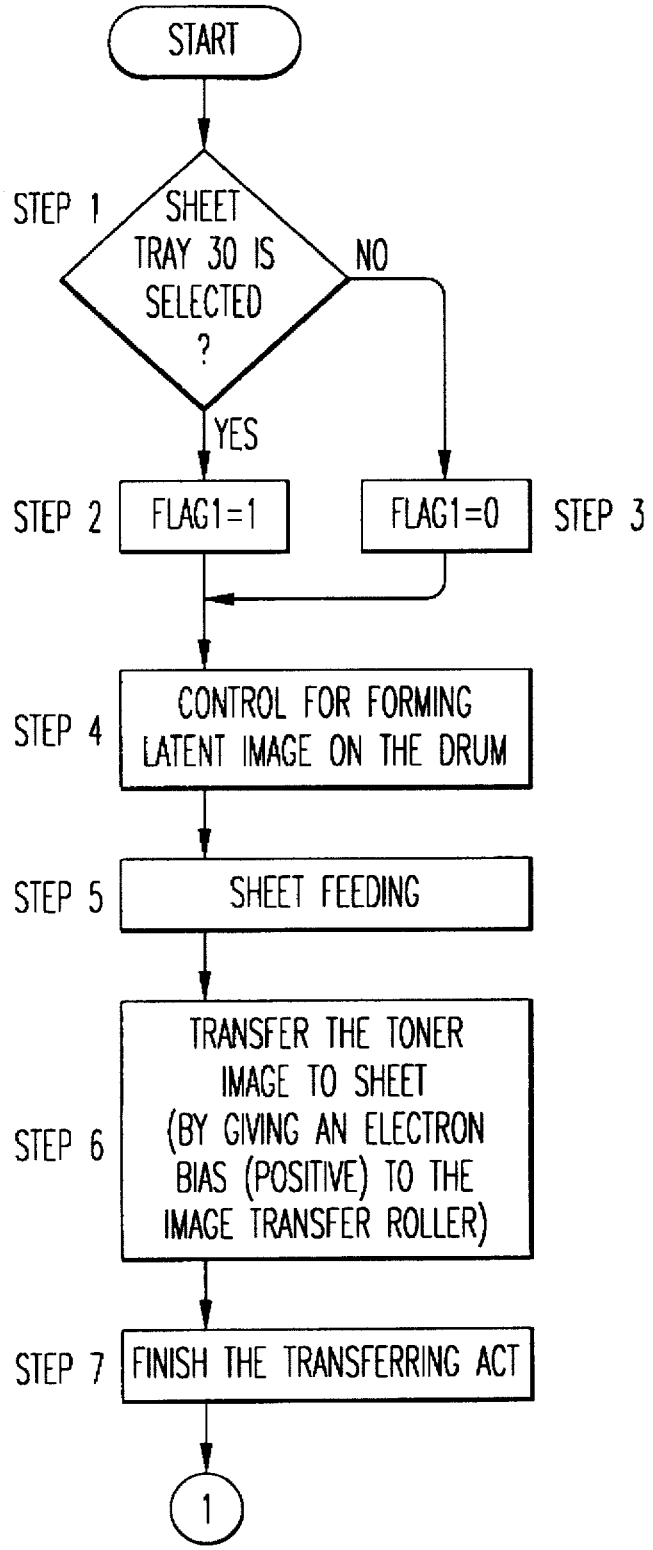
Figure 2B:
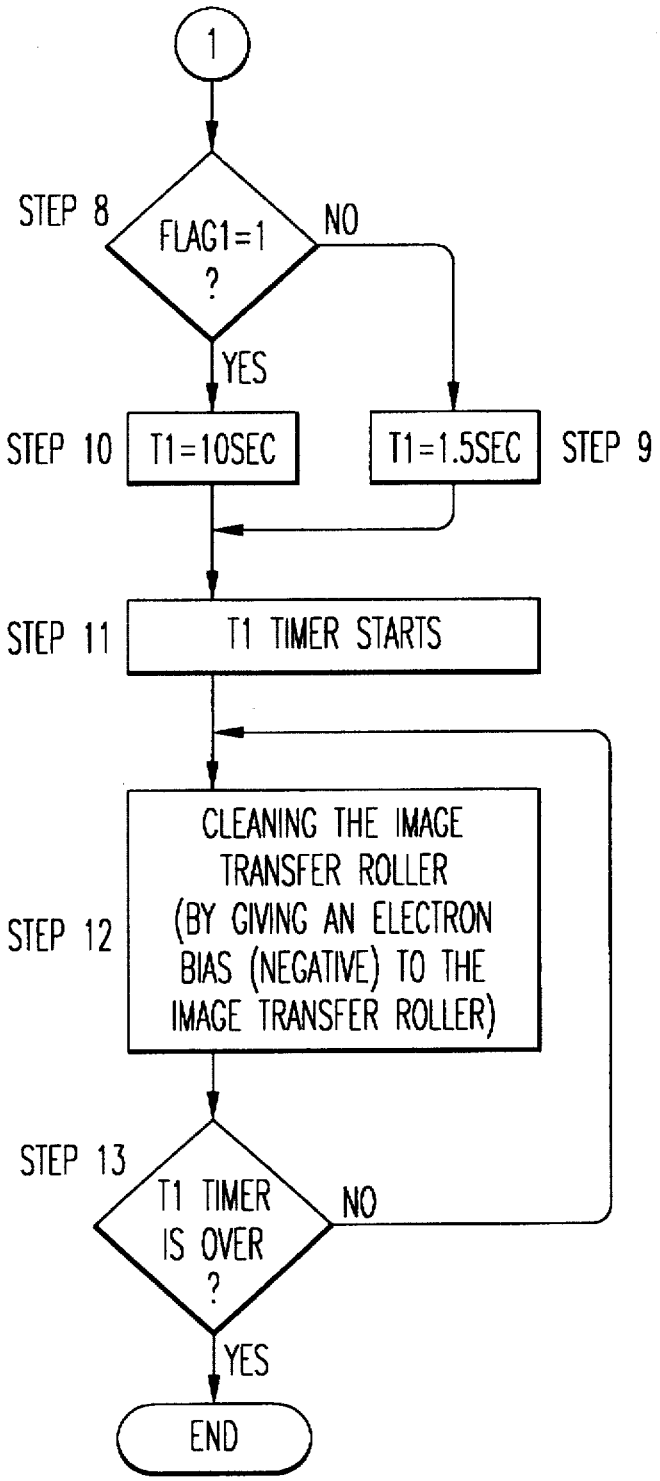

Next will be explained how to control the bias polarity for the image transfer roller 5. Referring to FIG. 2, it is first determined whether or not to select the sheet feeding tray 30. First, the control unit 50 tests for the presence of a signal from the feeding sensor 31 indicating that one or more sheets are in the sheet tray 30 (step 1). If so, the sheet tray 30 is selected and the control unit 50 sets "1" for a flag 1 in step 2. The other hand, when the paper feed cassette is selected in step 1 (the control unit 50 does not detect a signal from the sheet setting sensor), the control unit 50 sets "0" for the flag 1 (step 3).

Then the control unit 50 controls certain units for forming a latent image on the drum 1 in step 4 and drives the feeding roller 10 or 32 for feeding a sheet from the sheet tray 30 or the sheet feeding cassette 9 in step 5. The control unit 50 applies a positive bias to the image transfer roller 5 via the switch driver 54 and the select switch 51, and the toner image on the drum 1 is transferred to the sheet by the image transfer roller 5 (step 6).

After image transferring (step 7), the control unit 50 checks (step 8) whether or not the flag 1 is set to "1". When the flag 1 is set to "0", in case of selecting the sheet feeding cassette 9, the control unit 50 sets 1.5 sec on the timer T1 (step 9). The other hand, when the flag 1 is set to "1", in case the sheet tray 30 has been selected, the control unit 50 sets 10.0 sec on the timer T1 (step 10).

After that, the control unit 50 starts the timer T1, controls the drum 1 to rotate clockwise and applies a negative cleaning bias to the image transfer roller (step 12).

It is determined whether or not that time T1 is over in step 13. When the time T1 is over, the control unit 50 finishes the cleaning action.

Figure 3:
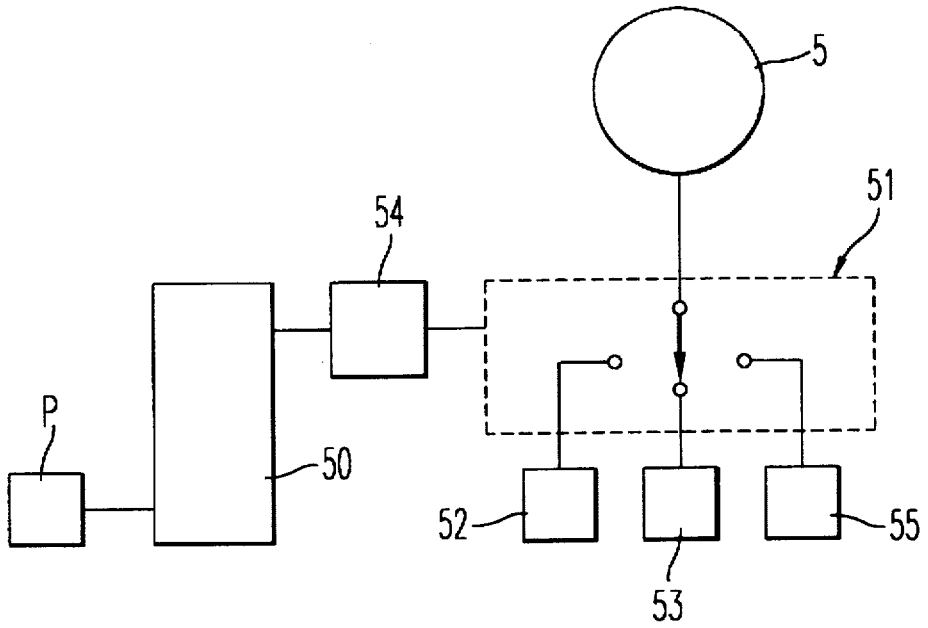
FIG. 3 is a section view showing a second embodiment of the image forming apparatus in accordance with the present invention.

In the above embodiment, the control unit 50 controls the clean up operation of the image transfer roller 5 by applying the negative bias for a longer time than usual. Referring to FIG. 3, the control unit 50 can instead select a higher voltage for the bias (−200 V to −600 V difference in electric potential of the drum 1 and the image transfer roller 5) for cleaning when the tray 30 is selected.

While the above provides a full and complete disclosure of the preferred embodiments of the present invention, various modifications, alternate constructions and equivalents maybe employed with out departing from the true spirit and the scope of the invention.

What is claimed is:

1. An electrophotographic image forming apparatus comprising:

a toner image forming device;

an image transfer device including an image transfer roller for transferring the toner image to a sheet in an image transferring operation;

one or more sheet feeding devices for feeding and conveying a sheet to said image transfer device;

a power supply for applying a bias to said image transfer device; and a control device for controlling the application of the bias so as to remove toner on said image transfer roller between image transferring operations, wherein said control device includes means for applying the bias for a predetermined time when the control device is aware of a width of the sheet conveyed to the image transfer device, and means for applying the bias for a longer time than said predetermined time when the control device is not aware of a width of the sheet conveyed to the image transfer device.

2. An electrophotographic image forming apparatus comprising:

a toner image forming device;

an image transfer device including an image transfer roller for transferring the toner image to a sheet in an image transferring operation;

one or more sheet feeding devices for feeding and conveying a sheet to said image transfer device;

a power supply for applying a bias to said image transfer device; and a control device for controlling the application of the bias so as to remove toner on said image transfer roller between image transferring operations, wherein said control device includes means for applying a bias of a predetermined voltage when the control device is aware of a width of the sheet conveyed to the image transfer device, and means for applying a bias of a higher voltage than said predetermined voltage when the control device is not aware of a width of the sheet conveyed to the image transfer device.

3. An electrophotographic image forming apparatus comprising:

a toner image forming device;

an image transfer device including an image transfer roller for transferring the toner image to a sheet in an image transferring operation;

at least two sheet feeding devices for feeding and conveying a sheet to said image transfer device, at least one of said feeding devices having a sheet width sensor;

a power supply for applying a bias to said image transfer device; and a control device for controlling the application of the bias so as to remove toner on said image transfer roller between image transferring operations, wherein said control device includes means for applying the bias for a predetermined time when the control device has received a signal indicative of a width of the sheet conveyed to the image transfer device, and means for applying the bias for a longer time than said predetermined time when the control device has not received a signal indicative of a width of the sheet conveyed to the image transfer device.

4. An electrophotographic image forming apparatus comprising:

a toner image forming device;

an image transfer device including an image transfer roller for transferring the toner image to a sheet in an image transferring operation;

at least two sheet feeding devices for feeding and conveying a sheet to said image transfer device, at least one of said feeding devices having a sheet width sensor;

a power supply for applying a bias to said image transfer device; and a control device for controlling the application of the bias so as to remove toner on said image transfer roller between image transferring operations, wherein said control device includes means for applying a bias of a predetermined voltage when the control device has received a signal indicative of a width of the sheet conveyed to the image transfer device, and means for applying a bias of a voltage higher than said predetermined voltage when the control device has not received a signal indicative of a width of the sheet conveyed to the image transfer device.

5. A method of forming an electrophotographic image, comprising the steps of:

forming a toner image;

feeding and conveying a sheet to an image transfer device from one of at least two sheet feeding devices, said image transfer device including an image transfer roller;

transferring the toner image to the sheet in an image transferring operation;

applying a bias to said image transfer device for cleaning said image transfer roller after said image transferring operation and before a further image transferring operation; and controlling the application of the bias so as to apply the bias for a predetermined time when the control device has received a signal indicative of a width of the sheet conveyed to the image transfer device, and applying the bias for a longer time than said predetermined time when the control device has not received a signal indicative of a width of the sheet conveyed to the image transfer device.

6. A method of forming an electrophotographic image, comprising the steps of:

forming a toner image;

feeding and conveying a sheet to an image transfer device from one of at least two sheet feeding devices, said image transfer device including an image transfer roller;

transferring the toner image to the sheet in an image transferring operation;

applying a bias to said image transfer device for cleaning said image transfer roller after said image transferring operation and before a further image transferring operation; and controlling the application of the bias so as to apply the bias with a predetermined voltage when the control device has received a signal indicative of a width of the sheet conveyed to the image transfer device, and applying the bias with a voltage greater than said predetermined voltage when the control device has not received a signal indicative of a width of the sheet conveyed to the image transfer device.

* * * * *